United States Patent [19]

Satoh et al.

[11] 4,296,948

[45] Oct. 27, 1981

[54] COLOR-DEVELOPING SHEET FOR NO-CARBON COPYING PROCESS

[75] Inventors: Tsutomu Satoh; Hideo Ohye; Hirokazu Tsukahara; Hideaki Senoh; Takahiro Torii, all of Takasago, Japan

[73] Assignee: Mitsubishi Paper Mills, Ltd., Tokyo, Japan

[21] Appl. No.: 98,176

[22] Filed: Nov. 28, 1979

[51] Int. Cl.[3] ..... B41M 5/16; B41M 5/22

[52] U.S. Cl. ..... 282/27.5; 427/150; 427/151; 428/328; 428/537; 428/914

[58] Field of Search ..... 282/27.5; 427/150, 151, 427/153; 428/307, 537, 913, 914, 323, 328, 331, 411

[56] References Cited

U.S. PATENT DOCUMENTS 4,054,718 10/1977 Garner et al. ..... 428/323 X

*Primary Examiner*—Bruce H. Hess

*Attorney, Agent, or Firm*—Cushman, Darby & Cushman

[57] ABSTRACT

A color-developing sheet for use in no-carbon copying system, which contains a layer of a combination of a solid acid with an acidic polymer is improved in preventing yellowing during the preservation thereof, in giving high color intensity and stability to image formed, by incorporating titanium dioxide into the layer.

7 Claims, No Drawings

COLOR-DEVELOPING SHEET FOR NO-CARBON COPYING PROCESS

The present invention relates to a color-developing sheet for use in no-carbon copying process. More particularly, it relates to a color-developing sheet for use in no-carbon copying process of which color-developing agent comprises a combination of a phenolic resin and an active silica compound, quite resistant to yellowing of color-developing sheet itself and to fading of the developed image even if exposed to sunlight, the light of fluorescent lamp or the atmospheric air for a long period of time.

In general, a no-carbon copying paper is constituted of a "top sheet" and a "bottom sheet", where the top sheet is a paper coated with microcapsules containing a solution of electron-donating colorless dye such as Crystal Violet Lactone, Benzoyl Leucomethylene Blue, Malachite Green Lactone, Rhodamine Anilinolactam, 3-diethylamino-6-methyl-7-anilinofluoran and the like in a non-volatile oily solvent, and the bottom sheet in a paper coated with an electron-accepting color-developing agent (a solid acid such as activated clay, acid clay, attapulgite or the like or an acidic polymer such as a phenol-formaldehyde resin) and an appropriate binder. When the two sheets are superposed so that their coated surfaces confront each other and a pressure of pencil or typewriter is applied thereto, the capsules in the pressed part are ruptured and the color-forming agent (colorless dye) transfers to and contacts with the color-developing agent to form a color, whereby a colored image is obtained.

As its applications, there are also known a "middle sheet" which is coated with color-forming and color-developing agents separately on its front and back sides, respectively, and is used by inserting between the top and bottom sheets, as well as a "self-contained paper" coated with a color-forming and a color-developing agents on the same side. Accordingly, a color-developing sheet for use in no-carbon paper should satisfy the following requirements:

(1) High whiteness and excellent resistance to yellowing after standing for a long period of time;

(2) High color intensity and high storage stability of the image formed; and (3) Good printing characteristics.

Attapulgite, acid clay, activated clay and the like, called under the generic name of solid acid, have a very porous surface, so that a color-developing paper prepared therefrom absorbs ink quite rapidly at the time of printing and has an excellent high-speed printability as a color-developing sheet for no-carbon copying process which requires a very high ink absorption as the result of the speed-up of printing in the current time. However, this type of color-developing sheet absorbs atmospheric moisture when left standing in the air for several months or gradually deteriorates its characteristics owing presumably to adsorption of atmospheric carbon dioxide and, as the result, loses its color-developing reactivity with a color-forming agent. In addition, the colored image obtained therefrom is poor in light resistance. Particularly in the case of black-colored image, it turns in red with time even if it is not exposed to direct sunlight. These facts greatly injure its commercial value in respect of storability.

In view of above, there have been a number of attempts to prevent the deterioration of color-developing ability of color-developing sheet prepared from these solid acids or to improve the light resistance of the colored image.

For example, Japanese Patent Publication No. 16965/1975 mentions that the discoloration of colored image can be reduced by incorporating an inorganic nitrous acid compound. In Japanese Patent Publication No. 16968/1975, it is mentioned that light resistance of colored image can be improved by incorporating a cyanamide-type organic compound or a metallic compound.

In Japanese Patent Publication No. 45245/1977, it is mentioned that the light resistance of colored image can be improved by using a composite silicate which had been reacted with an alkaline earth metallic compound. In Japanese Patent Publication No. 5247/1977, it is mentioned that a colored image can be made resistant to light by the coexistence with an organic carboxylic acid or its alkali metal salt. All these descriptions suggest that polyvalent metal compounds have an action to improve the color-developability or to stabilize the colored image. However, addition of these metallic compounds to solid acids cannot alter the essential character of solid acid even though it can improve color-developability or improve light resistance to some extent. Therefore, this technique cannot be said to be practical.

In addition, the addition of these metallic compounds sometimes exhibits a negative effect such as increasing the viscosity of coating fluid which deteriorates workability, coloring the color-developing sheet itself, deteriorating heat resistance and storage life of product, etc. which all lead to deterioration of performances as a color-developing agent. Therefore, this technique cannot be said to be practical.

In the light of the decrease of color-developability of solid acids occurring during longer storage or the insufficient light resistance of colored image, it has been proposed to use a phenolic resin as a color-developing agent which has an excellent color-developability and hardly shows deterioration of color-developability even after a longterm storage. (Japanese Patent Publication No. 20144/1967). Thereafter, an attempt has been published to use a solid acid in combination with a phenolic resin. (Japanese Patent Publication No. 17888/1975).

It is the object of this invention to improve a color-developing sheet in which an active silicic acid compound and a phenolic resin are used in combination as color-developing agents.

Thus, a color-developing sheet in which a mixture of active silicic acid compound and a phenolic resin is used as color-developing agent is superior to a color-developing sheet in which only active silicic acid compound is used as color-developing agent in respect of light resistance of developed image and stability of color formation even after a long term storage. As compared with a color-developing sheet in which only a phenolic resin is used as color-developing agent, it is improved in printing ink absorption and high-speed printability.

A color-developing sheet prepared from a combination of active silicic acid compounds and phenolic resins has the above-mentioned advantages. However, it is much more susceptible to yellowing than that prepared from phenolic resin alone. Thus, its improvement is considered necessary.

The yellowing is attributable to the character of phenolic resin itself which is susceptible to yellowing when exposed to sunlight or the light of fluorescent lamp. This tendency is particularly noticeable when a phenolic resin is combined with an active silicic acid compound of an advanced stage of activation, because its strong oxidative power promotes the yellowing change. Although a color-developing sheet prepared from a combination of phenolic resin and active silicic acid compound can satisfy the requirement concerning the performances of no-carbon paper, the yellowing injures its commercial value so that its practical application is impossible. For this reason, its improvement has been desired intensely.

Thus, the object of the present invention resides in providing a color-developing sheet of which color-developing agent comprises a combination of an active silicic acid compound and a phenolic resin having the following characteristic features:

(1) an improved resistance to yellowing, (2) an improved light resistance of colored image, and (3) an excellent printability.

The object of the present invention can be achieved by incorporating titanium dioxide into the layer of combined color-developing agents. In the invention, the process for producing no-carbon paper is not particularly limited. However, in a representative embodiment, the coating composition of color-developing agent is prepared by mixing an aqueous dispersion of acid clay or activated clay with an aqueous dispersion of finely powdered phenolic resin or a clay such as kaolinite or an adhesive such as starch or latex. The object of the invention can be achieved by mixing such a coating composition with titanium dioxide. In incorporating titanium dioxide, one may add it at the time of dispersing clay before dispersing an adhesive such as starch or latex. Alternatively, titanium dioxide may be added at the stage of agitation after the addition of adhesive, though it is recommendable to add titanium dioxide before the additive of adhesive from the viewpoint of dispersing effect.

The titanium dioxide used in the invention is generally produced from an ilmenite ore ($TiO_2$ 40–60%) by the sulfuric acid process, chlorine process, etc., though the invention is not particularly limited in the production process of titanium dioxide. Titanium dioxide can be classified into anatase and rutile based on the difference in crystal structure, and the power to prevent yellowing is somewhat dependent on crystal structure. Generally speaking, rutile is more effective than the other for the suppression of yellowing, so that rutile type titanium dioxide is preferable.

Such a titanium dioxide is usually available commercially at a relatively low price, and is not a particularly special substance. Since a sufficient effect can be obtained by adding a small quantity to the dispersion system of clay, the preparative work is quite simple and necessitates no complicated pretreatment nor special equipment. Therefore, its use is quite economical and advantageous.

The present inventors have conducted a study with the aim of employing, as a color-developing layer, a combination of phenolic resin and silicic acid compound with various white pigments such as activated clay, kaolinite, zeolite, or oxides, hydroxides, silicates or carbonates of metals such as calcium, magnesium, aluminum, zinc, titanium, manganese or the like. As the result, it has been found that the whiteness of color-developing sheet can be improved without injuring the quality of no-carbon paper by using zinc oxide, titanium dioxide, aluminum hydroxide, calcium carbonate, calcined kaolinite or the like in combination with phenolic resins and silicic acid compounds.

All the color-developing sheets prepared therefrom were comparable in the whiteness just after being prepared. However, after exposure to light, there was found a great difference from one another and titanium dioxide had the greatest effect for preventing yellowing, which was an unexpected fact. When incorporated into color-developing agent layer, it could exhibit a sufficient effect with an amount of 1/5–1/10 based on the other metallic compounds. If compared with zinc oxide which exhibits a relatively good effect at the same level of concentration, titanium dioxide exhibited an effect much exceeding zinc oxide. Regarding all the other characteristics as no-carbon paper such as stability of color-developing ability with the lapse of time, color intensity, workability in the preparation of coating composition, and printability, titanium dioxide gave good results. Thus, it was found that titanium dioxide is most effective in the color-developing sheet which employs a combination of active silicic acid compounds and phenolic resins.

Another pronounced effect obtained is that the light resistance of colored image can be improved by incorporating titanium oxide into the color-developing layer.

Accordingly, as compared with a color-developing sheet prepared from only phenolic resin and active silicic acid compound, the color-developing sheet of the invention is much improved in the resistance to yellowing and the developed image is much improved in resistance to light even when exposed to sunlight. In addition, it is possible to improve the commercial value and to offer a no-carbon paper having an excellent high-speed printability.

In order to further preventing the yellowing and further improving the light resistance of developed image, it is also possible to use, in combination with titanium dioxide, the above-mentioned metallic compounds, ultraviolet adsorbers, antioxidants and the like in the process of preparing a color-developing coating composition.

The active silicic acid compounds usable in the invention are general silicic acid compounds containing $SiO_2$ as its first component and having many Broensted acid points and/or Lewis acid points. Principal examples of said active silicic acid compounds include activated clay, acid clay, attapulgite, silica, silica-alumina, silica-magnesia, natural zeolite and the like. Composite metal silicate compounds obtainable by the reaction with compounds of zinc, aluminum or alkaline earth metals are also included. The invention is not particularly limited in the preparative process of active silicic acid compounds.

The phenolic resins usable in the invention are those known under the name of novolac type phenolic resins, such as phenol-formaldehyde resin, phenolacetylene resin and the like. Their examples include polycondensation resins obtainable by reacting formaldehyde or acetaldehyde with p-alkylphenol, p-octylphenol, p-nonylphenol and the like; arylphenols such as p-phenylphenol and the like; aralkylphenols such as $\alpha$-naphtylphenol, $\beta$-naphtylphenol, cumylphenol, benzylphenol and the like; and halogenated phenols such as p-chlorophenol and the like. The so-called heavy metal modified phenolic resins obtainable by modifying them with zinc or manganese are also included.

Said phenolic resins and said silicic acid compounds are preferably used in a proportion of about 1:2–16, and the amount of titanium dioxide added is in the range of 0.1–5 based on phenolic resin, and preferably in the range of 0.2–3. All these numerical figures are evidenced to be practical industrially.

The invention will be illustrated below by referring to the following examples which are presented in no limitative way. In the examples, all parts and percentages are by weight.

In the examples, the colored image was developed by combining a commercial top sheet (Mitsubishi NCR) with the color-developing sheet of the invention and passing them through a super calender roll under a loading pressure of 83 kg/cm$^2$.

EXAMPLE 1

0.5 part of sodium hexametaphosphate was dissolved in 150 parts of water. Into the solution were dispersed 40 parts of activated clay (Silton, manufactured by Mizusawa Chemical) and 15 parts of titanium dioxide (R-650, manufactured by Sakai Chemical). Then, 19 parts of 38% aqueous emulsion of p-phenylphenol resin (RBE-40, manufactured by Mitsui Toatsu) was added and dispersed.

pH of the fluid thus obtained was adjusted to 9.0 with caustic soda, and then 20 parts of 48% Dow Latex 636 (SBR latex manufactured by Asahi Dow) was added and homogenized to give a coating composition.

The latter was applied to a wood free paper (40 g/m$^2$) with a coating rod at an application rate of 5 g/m$^2$ on dry basis and dried. Thus, a color-developing sheet was obtained.

EXAMPLE 2

A color-developing sheet was prepared by repeating the procedure of Example 1, except that the activated clay was replaced with zinc-treated activated clay having a zinc content of 4.5%.

EXAMPLE 3

A color-developing sheet was prepared by repeating the procedure of Example 2, except that 5 parts of titanium dioxide and 55 parts of kaolinite was used.

COMPARATIVE EXAMPLES 1–5

In the same manner as in Example 1, 0.5 part of sodium hexametaphosphate was dissolved in 150 parts of water, 40 parts of zinc-treated activated clay and 45 parts of kaolinite were added to the solution with stirring, 15 parts of metallic compound shown below or kaolinite was added in place of titanium oxide, and 19 parts of 38% aqueous emulsion of phenolic resin was dispersed into the fluid. Then pH of the fluid was adjusted to 9.0 with caustic soda, and 20 parts of 48% Dow Latex 636 (SBR latex manufactured by Asahi Dow) was added and homogenized to give a coating composition.

The coating composition was applied to a wood free paper (40 g/m$^2$) at an application rate of 5 g/m$^2$ (solids) by means of a coating rod and dried to give a color-developing sheet.

Comparative Example 1: Aluminum hydroxide (Hidilight, manufactured by Showa Denkoh).

Comparative Example 2: Zinc oxide (Zinc Flower No. 3, manufactured by Sakai Chemical).

Comparative Example 3: Calcium carbonate (White Luster Flower PZ, manufactured by Shiraishi Industry).

Comparative Example 4: Kaolinite (Hydrasperse 90, J. M. Huber).

Comparative Example 5: Calcined kaolinite (Ansilex, J. M. Huber).

EXAMPLE 4

The color-developing sheets obtained above were examined for whiteness and the intensity change of colored image upon irradiation with sunlight under the conditions mentioned above. The results are summarized in Table 1.

TABLE 1

| | Whiteness* of developing sheet | | Intensity of colored image | | Titanium dioxide |
|---|---|---|---|---|---|
| | Before** | After*** | Before** | After*** | |
| Example 1 | 82.6% | 76.1% | 25.6% | 45.7% | used |
| Example 2 | 82.9 | 77.4 | 25.1 | 45.4 | used |
| Example 3 | 82.4 | 75.4 | 25.0 | 46.5 | used |
| Comp. Ex. 1 | 82.2 | 67.7 | 25.4 | 48.2 | not used |
| Comp. Ex. 2 | 82.6 | 72.5 | 24.0 | 47.0 | not used |
| Comp. Ex. 3 | 82.3 | 67.4 | 25.1 | 48.8 | not used |
| Comp. Ex. 4 | 81.9 | 67.3 | 25.2 | 48.3 | not used |
| Comp. Ex. 5 | 82.4 | 69.4 | 24.7 | 48.3 | not used |

*Blue filter was used.
**Before irradiation with sunlight.
***After irradiation with sunlight.

The numerical figures of Table 1 express the reflectances (%) of the coated surface before irradiation with sunlight and 10 hours after irradiation, measured by means of a color difference meter (manufactured by Nihon Denshaku K. K.). In the columns of whiteness, a smaller value of reflectance means more yellowing or more discoloration. In the columns of intensity, a smaller value of reflectance means that the color intensity is greater and the image is more resistant to light.

Table 1 demonstrates that yellowing of the color-developing sheet is more prevented and light resistance of the image is more improved by the use of titanium dioxide.

We claim:

1. A color-developing pressure sensitive sheet for use in no-carbon copying system, comprising a support and an electron-accepting color-developing layer thereon of a combination of a phenol-formaldehyde resin with a solid acid which is an active silicic acid, which are capable of developing color upon reacting with an electron-donating colorless dye, characterized in that titanium dioxide is incorporated into the said electron-accepting color-developing layer in an amount of from about 2 to about 4 parts by weight based on one part by weight of the phenol-formaldehyde resin.

2. A color-developing sheet as claimed in claim 1, in which the titanium dioxide is rutile.

3. A color-developing sheet according to claim 2 wherein the solid acid is an active clay.

4. A color-developing sheet according to claim 3 in which the combination ratio of the phenolformaldehyde resin with the solid acid is in the range of 1:2–16.

5. A color-developing sheet as claimed in claim 1, in which the solid acid is an active clay.

6. A color-developing sheet according to claim 5 in which the combination ratio of the phenol-formaldehyde resin with the solid acid is in the range of 1:2–16.

7. A color-developing sheet as claimed in claim 1, in which the combination ratio of the phenolformaldehyde resin with the solid acid is in the range of 1:2–16.

* * * * *